US006636252B2

(12) United States Patent
Hiraoka

(10) Patent No.: US 6,636,252 B2
(45) **Date of Patent: *Oct. 21, 2003**

(54) IMAGE EXPOSURE APPARATUS AND IMAGE FORMING APPARATUS WITH IT

(75) Inventor: Keiko Hiraoka, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/579,364

(22) Filed: Dec. 27, 1995

(65) Prior Publication Data

US 2001/0002139 A1 May 31, 2001

(30) Foreign Application Priority Data

Dec. 27, 1994 (JP) ..... 6-337988

(51) Int. Cl.[7] ..... B41J 2/45
(52) U.S. Cl. ..... 347/238
(58) Field of Search ..... 347/238, 130, 347/233, 247; 257/88, 98

(56) References Cited

U.S. PATENT DOCUMENTS

| | | | | | |
|---|---|---|---|---|---|
| 4,566,170 | A | * | 1/1986 | Dolan | 347/233 |
| 4,751,602 | A | * | 6/1988 | De Schamphelaere | 347/238 |
| 4,780,730 | A | * | 10/1988 | Dodge et al. | 347/237 |
| 5,317,344 | A | * | 5/1994 | Beaman et al. | 347/238 |
| 5,610,685 | A | * | 3/1997 | Aiba | 347/238 |
| 5,614,622 | A | * | 3/1997 | Audi et al. | 358/404 |
| 5,638,108 | A | * | 6/1997 | Nacman et al. | 347/238 |
| 5,640,190 | A | * | 6/1997 | Bollansee et al. | 347/240 |
| 5,684,523 | A | * | 11/1997 | Satoh et al. | 347/247 |

FOREIGN PATENT DOCUMENTS

| | | | | |
|---|---|---|---|---|
| EP | 0335553 | | 10/1989 | |
| JP | 60-44374 | * | 3/1985 | 400/121 |
| JP | 1238962 | | 9/1989 | |
| JP | 4-52153 | * | 2/1992 | 347/238 |

* cited by examiner

*Primary Examiner*—Thinh Nguyen
(74) *Attorney, Agent, or Firm*—Fitzpatrick, Cella, Harper & Scinto

(57) ABSTRACT

The present invention provides an image exposure apparatus comprising a substrate on which a plurality of light emitting elements are disposed. Wherein, the plurality of light emitting elements are arranged in a non-parallel relation to a longitudinal direction of the substrate.

12 Claims, 14 Drawing Sheets

GaAsP TYPE (HOMOJUNCTION)

AlGaAs TYPE (HETEROJUNCTION)

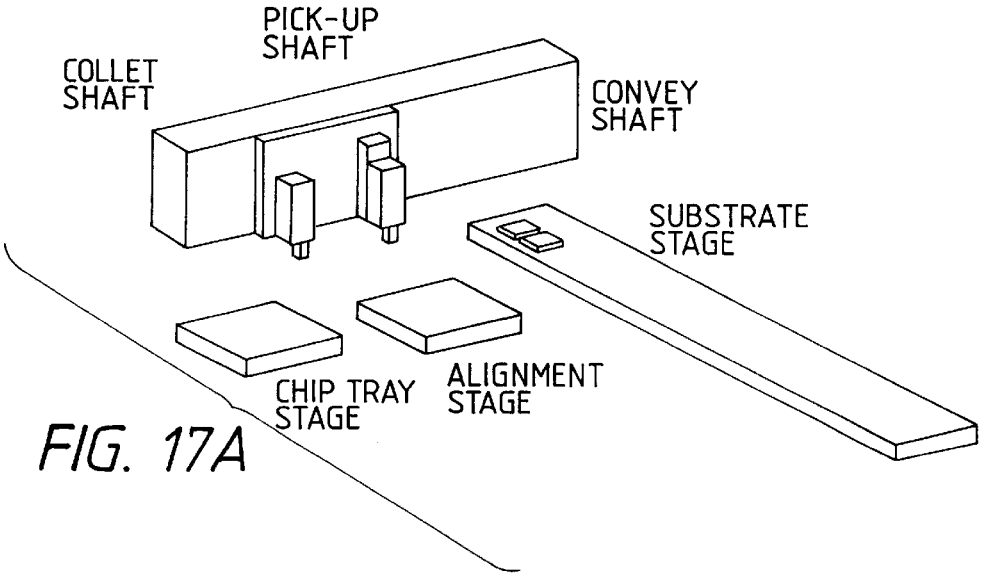
FIG. 17A
FIG. 17B
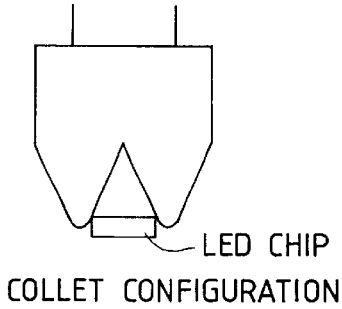
FIG. 18A
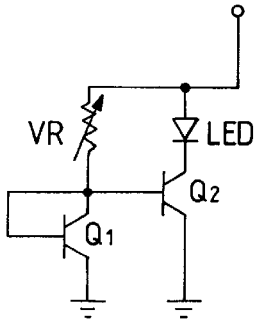
FIG. 18B
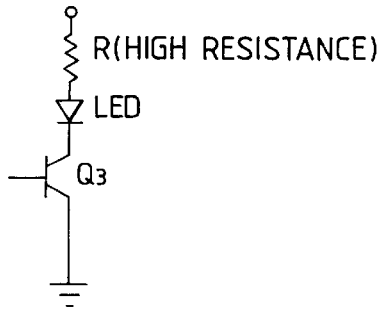

IMAGE EXPOSURE APPARATUS AND IMAGE FORMING APPARATUS WITH IT

BACKGROUND OF THE INVENTION

1. Field of the Invention

The present invention relates to an image exposure apparatus used with a copying machine, a printer and the like, and an image forming apparatus having such an image exposure apparatus, and more particularly, it relates to an image exposure apparatus in which an image is exposed by lightening a plurality of luminous elements such as LEDs.

2. Related Background Art

In conventional image forming apparatuses having an array of light emitting diodes (referred to as "LED" hereinafter) as an exposure source, an photosensitive drum is exposed by light emitted from the LED array and an image is formed on the photosensitive drum by an electrophotographic process. FIG. 12 schematically shows such as LED array. As shown in FIG. 12, a plurality of LED chips 101 are disposed on a substrate 102 of an LED array 100 equidistantly along a direction parallel with a rotational axis of a photosensitive drum (not shown). A length of the LED array 100 is determined by a length of the photosensitive drum. As shown in FIG. 13, each LED chip 101 includes a plurality (normally, 64 to 128) of light emitting points. FIGS. 14A and 14B show sections of the LED chip 101. The LED arrays are generally divided into two groups, i.e. GaAs group and AlGaAs group which have different features.

FIG. 14A shows the LED array of GaAs type wherein $GaAs_xP_{(1-x)}$ of n-type are formed on a GaAs substrate of n-type by a gas phase crystal growth method. In this case, as the rate of P is increased, a light emitting wavelength is lengthened to increase light emitting efficiency. A luminous junction is formed by forming a p-area in an n-GaAsP layer by thermal diffusion of zinc (Zn). An interface of the p-n junction acts as a light emitting diode. In general, in order to define the diffusion of zinc within a limited area of the light emitting portion, a film of $SiO_2$ is formed in an opening portion, and density of carrier is controlled through the film to effect the diffusion of zinc. P-electrodes for applying current are made of aluminium (Al) or Au—Se—Te alloy (gold/selenium/tellurium alloy) and an n-electrode is common to the arrays and is made of Au/Au—Ge—Ni (gold/gold-germanium-nickel).

The LED is an element for applying voltage to the p-n junction in a normal (positive) direction and for pouring small amount of carrier and for picking up natural light generated by re-binding of carrier. In order to improve the light emitting efficiency, it is important that internal quantum yield for converting the applied current into the light is maximized by utilizing direct transition to the re-binding process and that the emitted light is efficiently taken out to the exterior. The efficiency for taking out the light to the exterior (external quantum yield) is several percentage (%) or less since there are components entirely reflected into the interior of the semiconductor at a critical angle determined by refractive index of material or substance, and, thus, a major part of light is absorbed into the interior and consumed as heat. Accordingly, in the LED array, it is important that the efficiency of the internal quantum yield is improved by purifying the crystal and at the same time the efficiency of the external quantum yield is increased.

FIG. 14B shows the LED array of AlGaAs type wherein AlGaAs is formed on a GaAs substrate of p-type by a liquid phase crystal growth method. In this LED array, a mixture ratio between gallium (Ga) and aluminium (Al) can be controlled within a wide range. First of all, a p-layer of $Al_{(1-x1)}Ga_{x1}As$ on the p-substrate is grown, and then, an n-layer of $Al_{(1-x2)}Ga_{x2}As$ is grown, thereby forming a p-n junction portion between the layers. By changing x at the interface of the junction, it is possible to form heterojunction and to make the current applying efficiency (i.e., the re-binding contributing to the light emission) more effective. Further, since the value of $x_2$ can be selected as a transparent layer having less light-absorbing feature with respect to a light taking-out direction, it is possible to take out a larger amount of external light emitting output. Incidentally, the common electrode of p-side is made of AuZn—Ni—Au (gold/zinc-nickel-gold) and the electrode of n-side is made of AuGe—Ni—Au (gold/germanium-nickel-gold) and these electrodes become ohmic electrodes.

The LED array is formed by arranging the plural LED chips as mentioned above side by side on the substrate 102 (die bonding). All of the light emitting elements (pixels) in the LED chip 101 are connected to corresponding wires (wire bonding). The LED (light emitting element) is illuminated by applying current to the corresponding wire. The light emitting points 103 are equidistantly disposed in the chip. Since the pixels are associated with the wires one by one, for example, when there are 128 light emitting points 103 in one LED chip 101, the number of the wire bondings becomes 128. FIG. 15 is a perspective view showing a condition that the LED chips 101 are mounted on the substrate in this way and the light emitting elements in the LED chips are connected to drivers by wire bondings.

Next, a method for driving the LED will be explained.

In order to drive the LED, generally, a driving method utilizing constant current driving elements is used. The constant current driving methods are generally grouped into two methods as shown in FIGS. 18A and 18B. In the first method, internal resistance is added to a P-channel open drain CMOS circuit or serial resistance as external resistance is added (serial resistance type). In the second method, a constant current circuit is provided by controlling a gate voltage of a driver IC. The second method having less current fluctuation in comparison with the first method is more preferable for voltage fluctuation. In FIG. 18A, the current is made constant by base current $Q_1$ of transistor $Q_2$, thereby controlling the driving current of the LED. On the other hand, in FIG. 18B, false constant current is established by high resistance R.

Methods for inputting a signal are generally grouped into four, as shown in FIGS. 19A to 19D. In the methods shown in FIGS. 19A and 19B, signals are successively supplied to shift registor(s) and are latched upon illumination, and an output signal is time-controlled by an enable signal, thereby determining a time period for illuminating the LED. The difference between FIGS. 19A and 19B is that the entire head is constituted by a single serial shift register (FIG. 19A), whereas, the signals are supplied, in parallel, to a plurality of input terminals of plural shift registers.

In the method shown in FIG. 19D, the division is effected every one dot, and this method apparently bears resemblance to a parallel input method shown in FIG. 19C.

FIG. 19C shows the complete parallel input fashion, in which the data are always inputted to the head in parallel and the light emitting position is determined by the timing of the latches. Now, the method shown in FIG. 19C will be further fully explained. Eight-bit parallel signals are inputted to n-th (n=0 to 7; eight in total) ports in accordance with the latch signal of the data, and the 8-th to 15-th data are read by the next clock input. After all of the data are latched, the data are transferred to another latch portion, where light emitting time period for illuminating the LED is determined.

Regarding the characteristics shown in FIGS. 19A, 19B and 19C, in FIG. 19A, the maximum speed is limited by a transmitting speed of the shift register, and in FIGS. 19B and 19C, since the time period is reduced to 1/n (n is the number of the input ports), the high speed operation can be expected. Particularly, the circuit shown in FIG. 19C is suitable for the highest speed operation since there is no data transmission.

In any cases, in the final output stage, in the case where the light emitting dots in the LED is great, particularly, when all of the light emitting elements are illuminated simultaneously, even if a single dot is illuminated by current of 5 mA, since 3000 to 4000 dots are illuminated simultaneously, large current in the order of 15 to 20 A will be applied to the entire head. Accordingly, the resistance values of a power source and an earthing wire which constitute a common line must be decreased. Although the LED can be sufficiently driven by the current of 5 A, electric power of 100 W (=5 mA×5 V×4000) is consumed in the head. Thus, adequate cooling is required for heat.

However, in the arrangement wherein the pixels correspond to the wires one by one, as the density of the pixels is increased, since the dimension of each pixel is decreased, the density of the wire bondings is also increased. As a result, there arises a problem that the adjacent wires are contacted with each other and/or the wire is broken since due to fineness. Since it is considered that the density of the LED pixels will be further increased, the above problem must be solved.

To solve the above problem, there has been proposed a technique in which the shift register is mounted on the LED element itself so that the light emitting points 103 in the LED is successively transferred from LED chip to LED chip. By using the LED of this kind, since there is no need to connect the wires to the LED pixels one by one, even when the density of the LED pixels is increased, the number of the wire bondings can be greatly reduced.

However, when a straight line having a length greater than the single LED chip 101 is written along a main scan direction by using the shift register mounted LED array as an exposure means of an electrophotographic image forming apparatus, since the transferring speed of the light emitting point 103 of the LED and a rotational speed of a photosensitive drum of the image forming apparatus are limited, it is feared that an exposure line on the photosensitive drum is deviated from the main scan direction to distort the straight line.

Further, although such distortion can be eliminated by increasing the transferring speed of the light emitting point 103 of the LED, if do so, since the light emitting time period of each pixel is decreased to reduce the exposure amount. This is not preferable. Further, since the transferring speed of the light emitting point 103 is limited, the LED chips 101 themselves are subjected to load.

SUMMARY OF THE INVENTION

The present invention aims to eliminate the above-mentioned conventional drawbacks, and an object of the present invention is to provide an image exposure apparatus and an image forming apparatus having such an exposure apparatus, which can prevent deviation or shift of exposure point on a photosensitive member.

Another object of the present invention is to provide an image exposure apparatus and an image forming apparatus having such an exposure apparatus, in which the number of wire bondings is reduced and degree of image dissector is improved.

A further object of the present invention is to an image exposure apparatus in which a plurality of light emitting elements are disposed on a substrate and these light emitting elements are arranged along a longitudinal direction of the substrate in a nonparallel relation.

A still further object of the present invention is to an image forming apparatus comprising a photosensitive member, and an exposure means including a plurality of light emitting elements to expose the photosensitive member. Wherein the plurality of light emitting elements are disposed in a non-parallel relation with respect to generatrix of the photosensitive member.

The other objects and features of the present invention will be apparent from the following detailed explanation of the invention.

BRIEF DESCRIPTION OF THE DRAWINGS

FIG. 17A is an explanatory view showing a manufacturing apparatus when the LED chips are mounted on a substrate, and FIG. 17B is a view showing a main portion of the apparatus;

FIGS. 18A and 18B are drive (constant current drive) circuits for driving the LED;

DETAILED DESCRIPTION OF THE PREFERRED EMBODIMENTS

Figure 1:
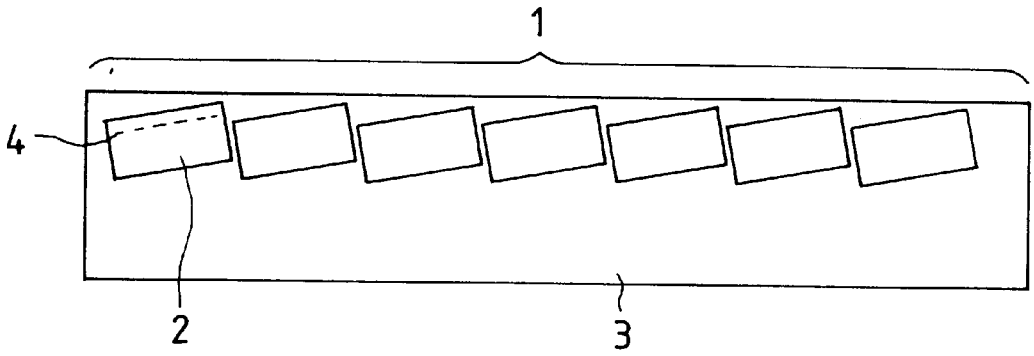
FIG. 1 is a schematic illustration showing an LED array according to a first embodiment of the present invention.
Figure 2:
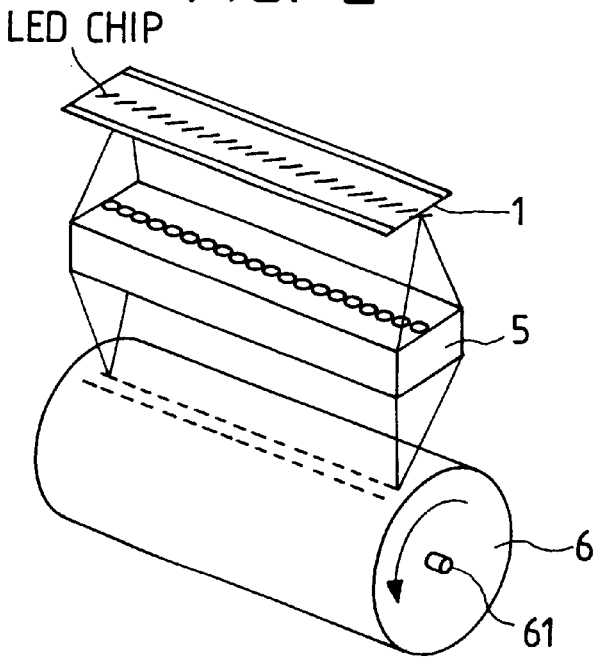
FIG. 2 is a perspective view of a main portion of an image forming apparatus having the LED array of FIG. 1.
Figure 5:
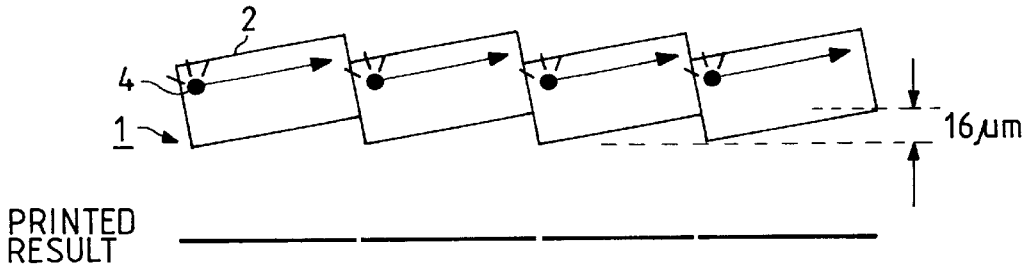
FIG. 5 is a schematic illustration showing a printed result obtained when die bondings of a plurality of LED chips of the first embodiment of the present invention are inclined with respect to a rotational axis of a photosensitive drum by an predetermined angle.

An exposure apparatus having an LED array according to a first embodiment of the present invention is shown in FIGS. 1, 2 and 5. In the LED array according to the illustrated embodiment, a plurality of LED chips 2 are equidistantly disposed on a substrate 3 along a rotational axis 61 of a photosensitive drum 6 (die bonding), and the LED chips 2 are inclined with respect to the substrate and the rotational axis 61 of the photosensitive drum 6.

In each LED chip 2, a plurality (normally, 64 to 128) of LEDs 4 are equidistantly mounted on the LED chip along one side thereof. Further, a shift register for successively transferring a plurality of light emitting points 4 also mounted on the LED chip. In order to explain the construction of the LED chip, a method for manufacturing such an LED chip will now be explained with reference to FIGS. 16A to 16D.

Figure 16A:
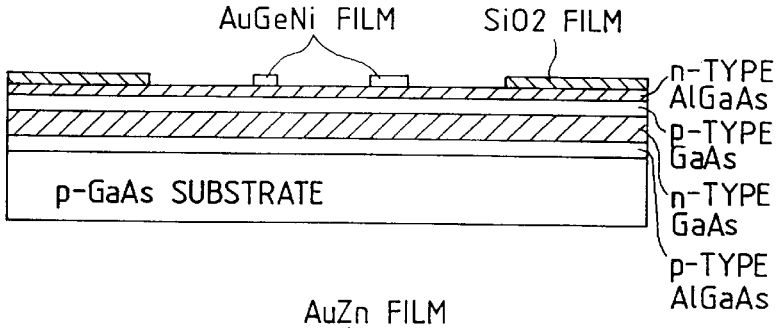
FIGS. 16A to 16D are sectional views showing a method for manufacturing an LED array of shift register mounted type used in the present invention.
Figure 16B:
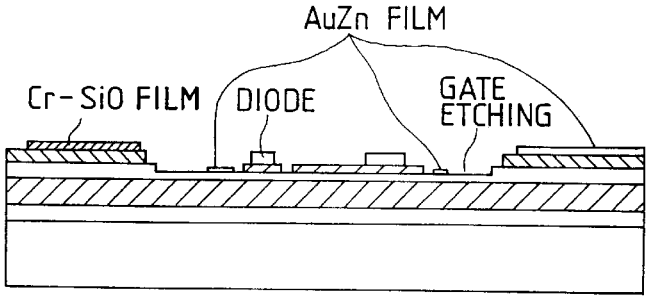
Figure 16C:
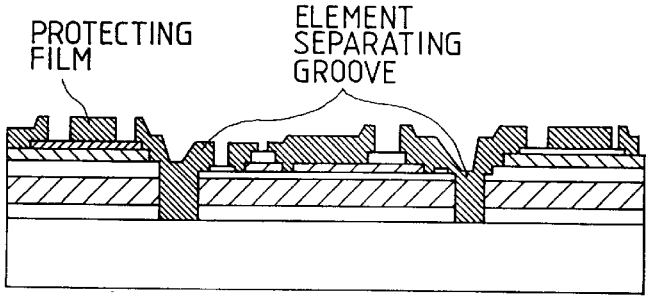
Figure 16D:
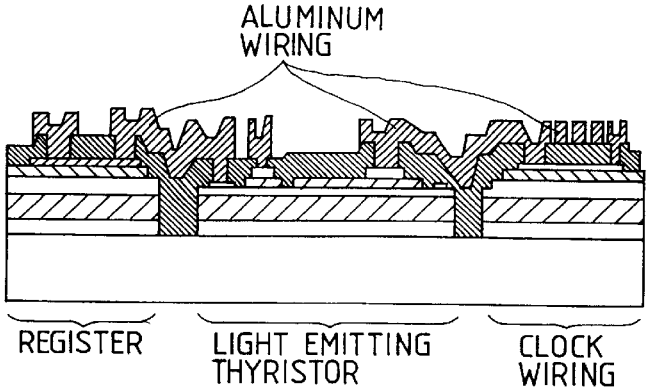
Figure 19A:
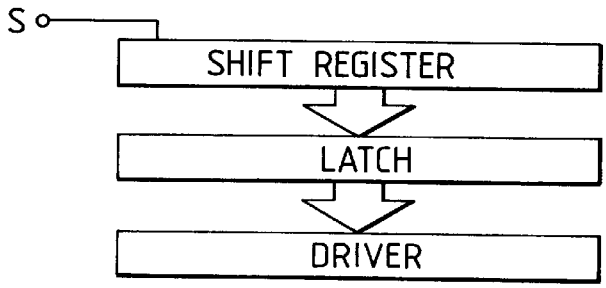
FIGS. 19A to 19D are drive circuits (signal inputting methods) for driving the LED.
Figure 19B:
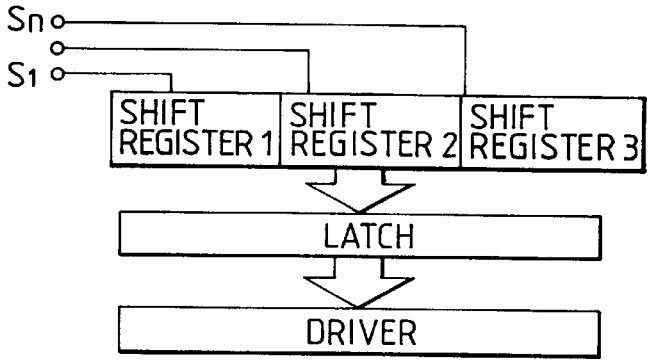
Figure 19C:
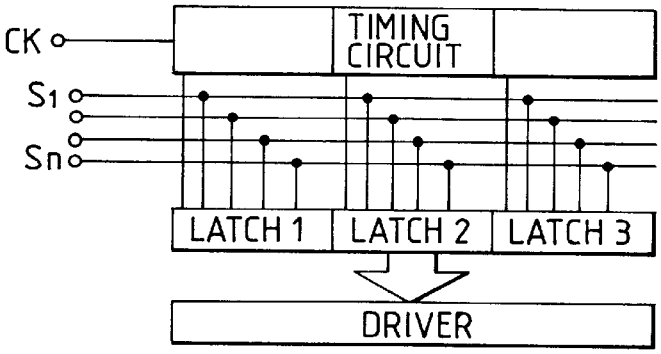
Figure 19D:
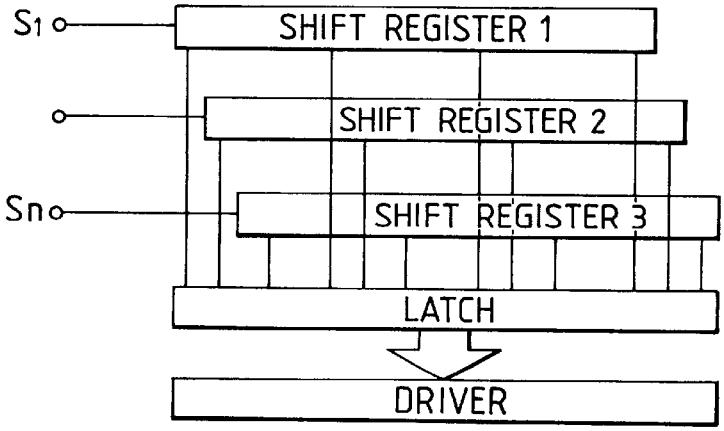

First of all, p-AlGaAs, n-GaAs, p-GaAs and n-AlGaAs are grown on a GaAs substrate by MOCVD (metal organic chemical vapor deposition). Then, as shown in FIG. 16A, a surface insulation film made of $SiO_2$ is formed, an n-electrode made of AuGeNi is formed and a thin film resistance is formed. Then, gate p-electrodes made of AuZn are formed by wet etching (FIG. 16B). Element separation grooves are formed by etching, and a protection layer is formed from polyamide (FIG. 16C). Through holes are formed, and, lastly, Al (aluminium) wirings are provided (FIG. 16D).

By adding the shift register function to the LED, the number of the bonding wires can be reduced to increase the density of the LEDs, and, since the number of driver ICs can be reduced, an LED head can be made compact.

Next, a method for cutting the LED chip element formed on a wafer in this way will be explained. There are two methods for cutting the LED chip element formed on the wafer through a mask by semi-conductor process. That is to say, (1) a method for cutting (dicing) the LED chip by means of a dicing machine having a circular thin blade rotated at a high speed, and (2) a method for cutting the LED chip by cleavage through grooves (such as making-off scratches) formed in the wafer.

Figure 23:
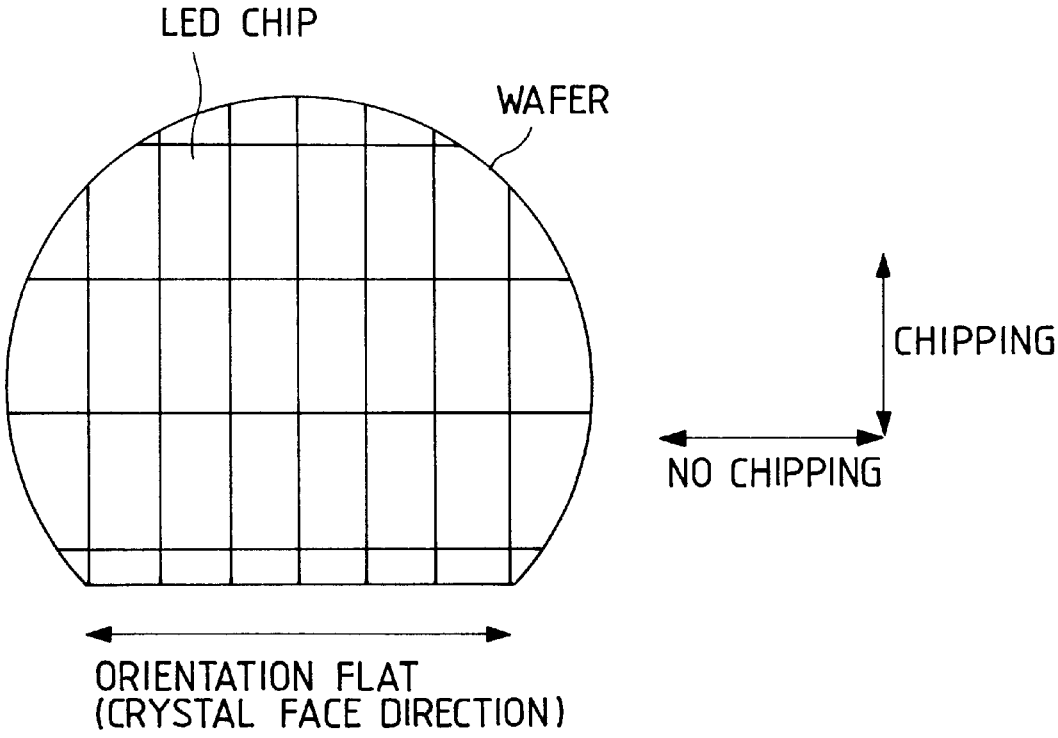
FIG. 23 is an explanatory view showing an LED chip element before it is cut into a plurality of LED chips.

In the method (1), although the chiping is apt to be created along the cut line, due to the feature of the GaAs wafer shown in FIG. 23, since the chiping is hard to be created in a surface parallel with orientation flat (crystal face direction), in case of LED chip, the chips are formed so that a short side (perpendicular to the array of light emitting elements) of each LED chip is aligned with the orientation flat.

In the method (2), the feature that wafer is apt to be broken straightly along the crystal faces and faces perpendicular thereto is utilized. Since the chiping is considerably small in comparison with the method (1), the method (2) is particularly suitable to break short sides of the LED chip having high resolving power.

The LED chips manufactured by the above-mentioned process is mounted on a substrate such as an insulation substrate made of glass epoxy, a ceramic substrate made of alumina, an insulated metal substrate or the like.

Now, an LED mounting method will be explained with reference to FIGS. 17A and 17B. FIG. 17A shows a body of a die bonder. The die bonder comprises a chip tray stage on which the chips subjected to the dicing are stored, an alignment stage for effecting the alignment of chips, a substrate stage on which the chips are mounted, a pick-up shaft extending perpendicular to the stages, a collet shaft extending perpendicular to the stages, and a convey shaft for conveying the chips. The LED chips are conveyed by means of the pick-up shaft from the chip tray stage to the alignment stage, where the chips are positioned before the die bonding. Thereafter, the chips are conveyed by means of the collet shaft to the substrate stage, where the chips are adhered to predetermined positions on the substrate (die bonding).

Next, a driving principle for the LED chip of shift register mounted type will be explained.

The LED chip of shift register mounted type performs the shift register function for the light emitting points by using a pnpn-light emitting thyristor.

Figure 20:
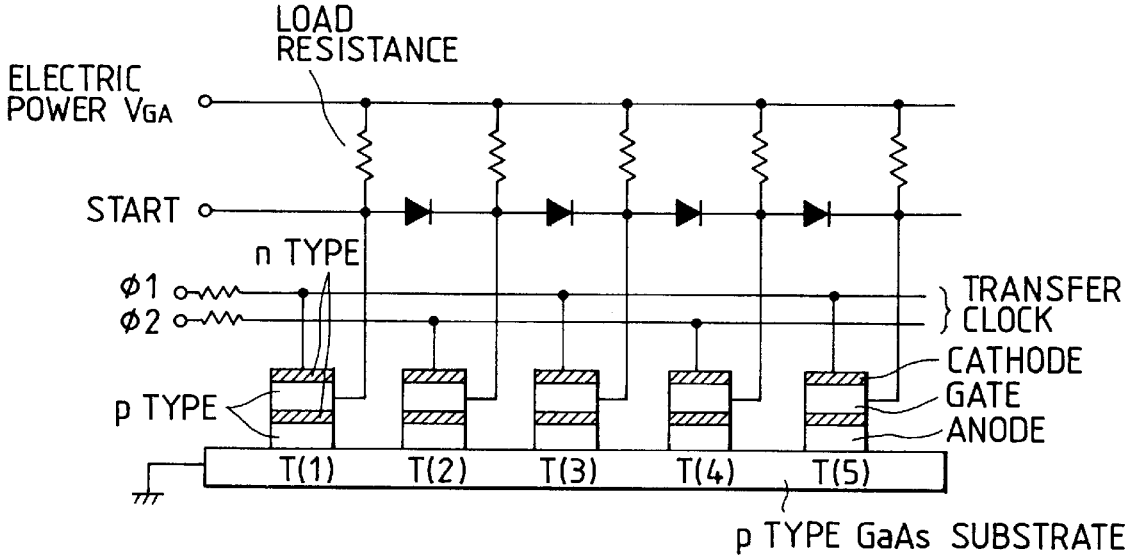
FIGS. 20 and 21 are views showing equivalent circuits for the LED array of shift register mounted type.

FIG. 20 shows an equivalent circuit for the LED chip of shift register mounted type. The light emitting thyristor (fundamental element) has pnpn-construction. The substrate (p type) constitutes anodes, an upper layer (n type) constitutes cathodes and an intermediate layer (p type) constitutes gates. S-shaped negative resistance feature is provided between the anode and the cathode, and, it is known that cathode turn ON voltage $V_{c\cdot ON}$ is depended upon gate voltage $V_G$. That is to say, $V_{c\cdot ON}=V_G-V_{dif}$. In order to turn OFF the thyristor, the cathode voltage may be increased to zero volt. Further, the gate terminals in an ON condition are increased to anode potential (zero volt). The gate terminals of the light emitting thyristor of the LED chip of shift register mounted type are connected to each other through a diode and are connected to an electric power $V_{GA}$ through load resistances RL. To effect the transferring operation, transfer clocks $\phi_1$, $\phi_2$ are applied to the cathodes. If T(3) is in a low level condition by low level voltage of the transfer clock $\phi_1$, the gate potential becomes substantially zero volt. This potential affects an influence toward the right direction through the diode. Thus, since only the rightward elements are selectively turned ON by the low level voltage of the next clock $\phi_2$, the light emitting (point) can be transferred to the right direction. In place of the potential connection through the diode, resistance connection may be used.

Figure 21:
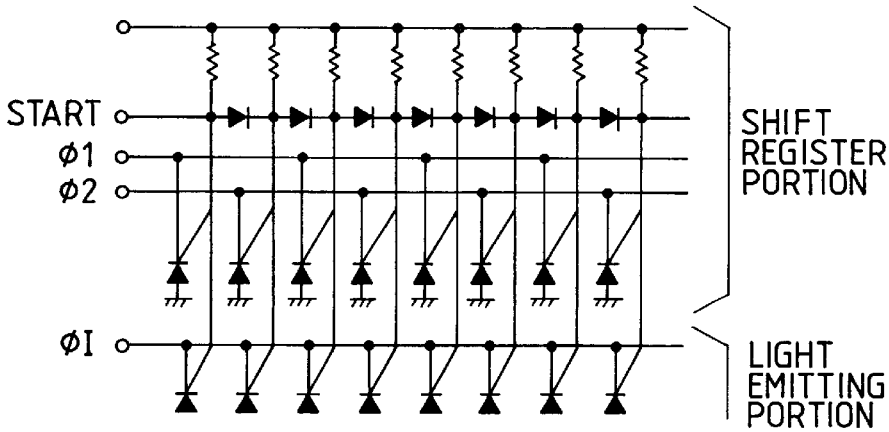

FIG. 21 shows an equivalent circuit in which another printing light emitting thyristor is addressed by one light emitting point which is shifted on the LED. Each of thyristors constituting the LED is connected to a corresponding printing light emitting thyristor. The printing light emitting thyristor can be illuminated by the low level voltage of the clock $\phi_1$.

Next, an operation of the circuit will be explained. One ON condition scans the surface of the LED of address the printing light emitting thyristor. In synchronous with this scan, the clock $\phi_1$ corresponding to the image information is applied. In this method, since only the addressed thyristor becomes the ON condition, only one light emitting element is activated. For example, regarding 128 bit elements, although the duty is low, since analogue modulation of light emitting intensity can be effected by controlling the low level voltage value of the clock $\phi_1$, the intermediate tone can be obtained. Thus, since the LED elements are not required to be connected to the wires one by one, even when the density of the LED elements is increased, the number of wire bondings for applying the current to the elements to lighten it can be greatly decreased.

Figure 22:
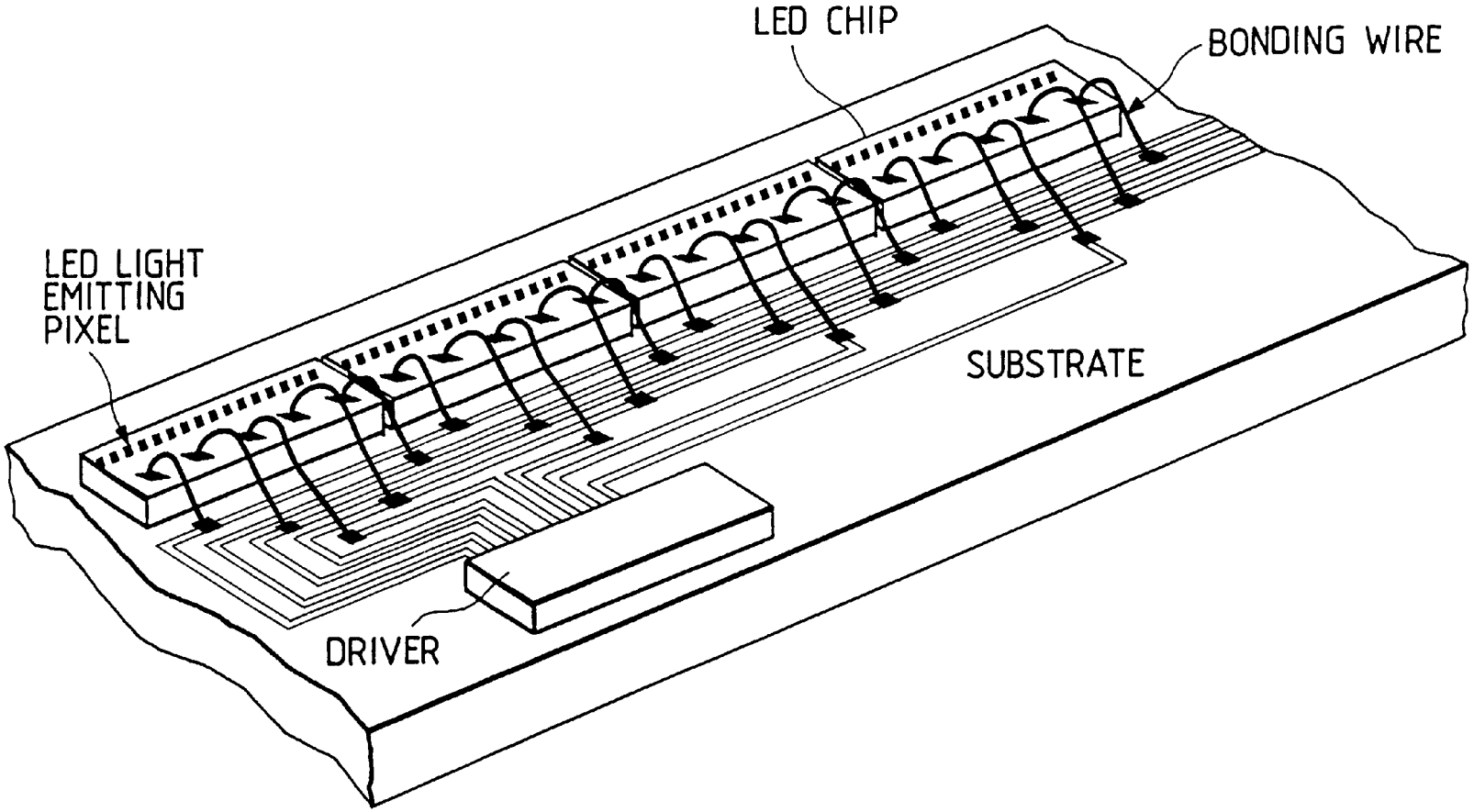
FIG. 22 is a partial perspective view of the LED array having LED chips of shift register mounted type.

FIG. 22 shows a condition that the LED chips are mounted on the substrate and the wire bondings are effected. Incidentally, in this Figure, the LED chips are disposed on the substrate in such a manner that a plurality of light emitting elements (pixels) which are inclined with respect to the longitudinal direction of the substrate are arranged side by side. The inclination angle of each LED chip 2 with respect to the substrate 3 and the rotational axis 61 (or drum generatrix) of the photosensitive drum 6 is determined by the transferring speed of the light emitting points 4 in the LED chip 2, the resolving power of the LED and the scan speed (peripheral speed) of the photosensitive drum 6.

FIG. 2 shows a main portion of an image forming apparatus using the LED array according to the first embodiment of the present invention. As shown in FIG. 2, the light emitted from the LED array 1 passes through a SELFOC lens 5 and is exposed on the photosensitive drum 6 to form a latent image which is in turn visualized by the subsequent electrophotographic process.

Now, image exposure will be explained regarding an LED array 1' (refer to FIG. 4) wherein a plurality of LED chips 2 are disposed side by side in a line in parallel with the rotational axis 61 of the so that a plurality of light emitting elements are arranged in parallel with the generatrix of the photosensitive drum.

Figure 3:
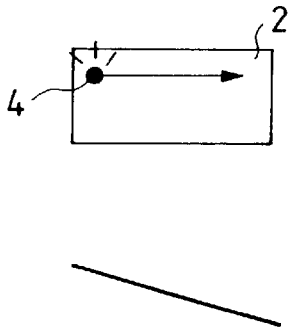
FIG. 3 is a schematic illustration showing a condition that the imaged result is deviated if an LED chip of light emitting point transferring type is used.
Figure 4:
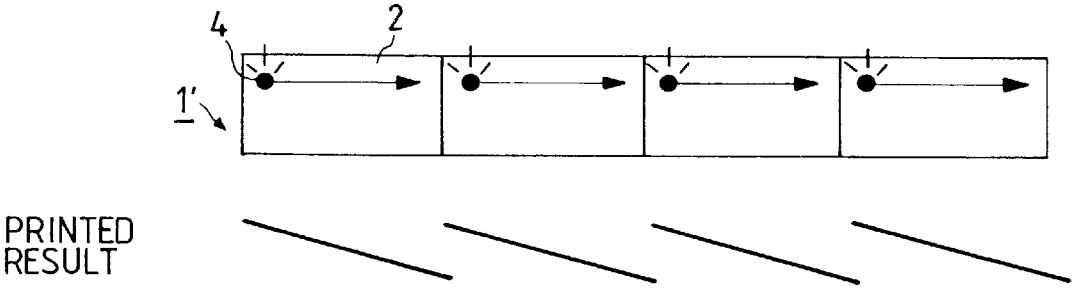
FIG. 4 is a schematic illustration showing a result obtained when a straight line is written by using the LED array of light emitting point transferring type.

For example, when it is assumed that the degree of image dissector of the LED is 600 dpi, the transferring frequency of each light emitting point 4 in the LED chip 2 is 800 kHz, the number of the light emitting points 4 in each LED chip 2 is 128 and the peripheral speed of the photosensitive drum 6 is 100 mm/sec, as shown in FIG. 3, while the light emitting point 4 is being transferred from one end to the other end of each LED chip 2 (5.42 mm), the trace on the photosensitive drum 6 is deviated from the original or initial position by an amount of 16 $\mu$m (=128×(1/800 kHz)×100 mm/sec) in the sub scan direction. In the case where the degree of image dissector of the LED is 600 dpi, since the pixel size is 42.3 $\mu$m, the value of 16 $\mu$m corresponds to about 38% of the pixel size. If the straight line corresponding to the length of the LED array 1' tries to be described, as shown in FIG. 4, the printed result shows the fact that inclined lines each having inclination of 16 $\mu$m between the LED chips 2 are repeated.

To eliminate such image deviation, in the illustrated embodiment, as shown in FIGS. 1 and 5, when the die bonding is effected, each LED chip 2 is inclined with respect to the rotational axis 61 of the photosensitive drum 6 by an angle corresponding to the deviation value of 16 $\mu$m so that the plurality of light emitting elements are arranged in no-parallel relation to the generatrix of the photosensitive drum. With this arrangement, it is possible to avoid the image distortion which may caused when the LED chips 2 are disposed in a line parallel with the rotational axis 61 of the photosensitive drum.

Figure 6:
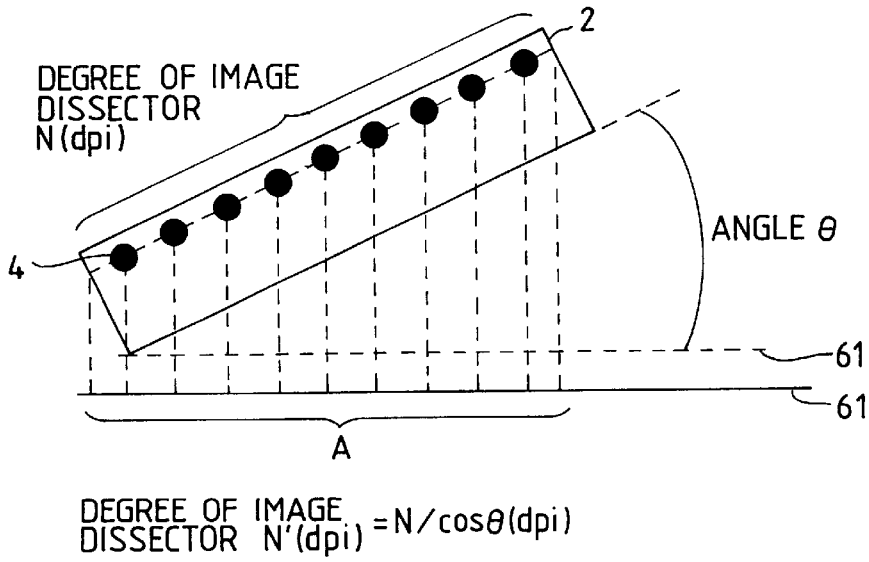
FIG. 6 is a schematic illustration showing a printed result in which degree of image dissector is changed when the inclination of the LED chips is great.
Figure 7:
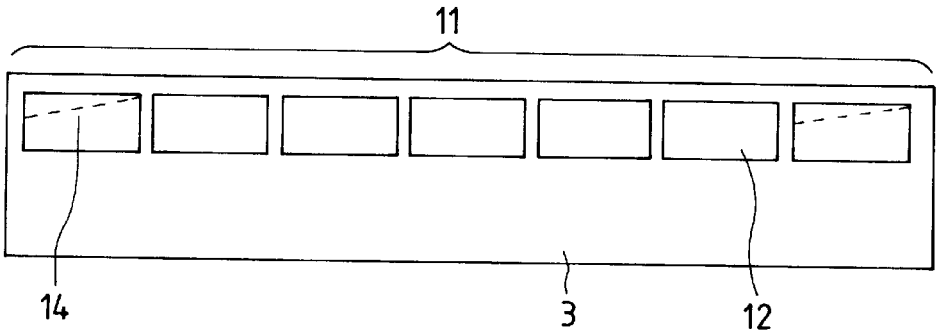
FIG. 7 is a schematic illustration showing an LED array according to a second embodiment of the present invention.
Figure 8:
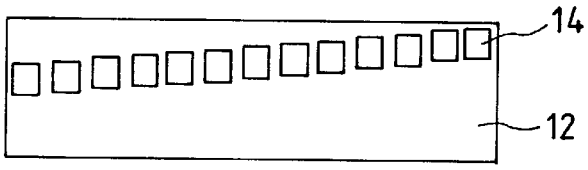
FIG. 8 is a plan view of an LED chip according to the second embodiment of the present invention.

Incidentally, if the LED chips 2 are greatly inclined with respect to the rotational axis 61 of the photosensitive drum 6, as shown in FIG. 6, the degree of image dissector of the LED N(dpi) will differ from the degree of image dissector of the pixel N'(dpi) written on the photosensitive drum 6. When an angle between the LED chip 2 and the rotational axis 61 of the photosensitive drum 6 is θ, the degree of image dissector N'(dpi) on the photosensitive drum 6 becomes greater than the degree of image dissector of the LED N(dpi) by (1/cos θ) times, with the result that the substantial conversion of the degree of image dissector occurs in the exposure system (as shown by the arrow A).

However, in the illustrated embodiment, since the inclination angle θ corresponding to the deviation value of 16 $\mu$m is below 1°, the conversion (change) of the degree of image dissector can be neglected. Further, if the image deviation corresponding to one LED chip 2 on the photosensitive drum 6 may be suppressed within ½ of the pixel size (not completely eliminated as mentioned above), a relation between the peripheral speed p (mm/sec) of the photosensitive drum 6 and the transferring speed v (Hz) of the light emitting point 4 may satisfy $p/v<1.65\times10^{-4}$.

Accordingly, in consideration of the exposure light amount depending upon the light emitting time of the light emitting point 4, for example, when the upper limitation of the transferring time of the LED light emitting point 4 is selected to 1 MHz, the peripheral speed p of the photosensitive drum 6 becomes p<165 mm/sec.

Second Embodiment

A second embodiment of the present invention will be explained with reference to FIGS. 7 to 11.

In an LED array used in the second embodiment, a plurality of LED chips 12 are equidistantly disposed on a substrate 13 in parallel with a rotational axis 61 of a photosensitive drum 6 (die bonding) so that the LED chips 12 are arranged in a line in parallel with the substrate 13 and the rotational axis 61 of the photosensitive drum 6. However, in this embodiment, since a plurality of light emitting elements in each LED chip are arranged in a non-parallel relation to a longitudinal side of the LED chip, the plurality of light emitting elements are disposed in a non-parallel relation to a longitudinal direction of the substrate (or generatrix of the photosensitive drum).

Each LED chip 12 has a plurality (normally, 64 to 128) of light emitting points 14 which are equidistantly disposed to each other, and, a shift register (not shown) for successively transferring the plurality of light emitting points 14 in the LED chip 12 is mounted on the LED chip 12. With this arrangement, since pixels are not required to be connected to wires one by one, even when the density of the LED pixels is increased, it is possible to greatly reduce the number of wire bondings for applying current to lighten the LED.

Figure 9:
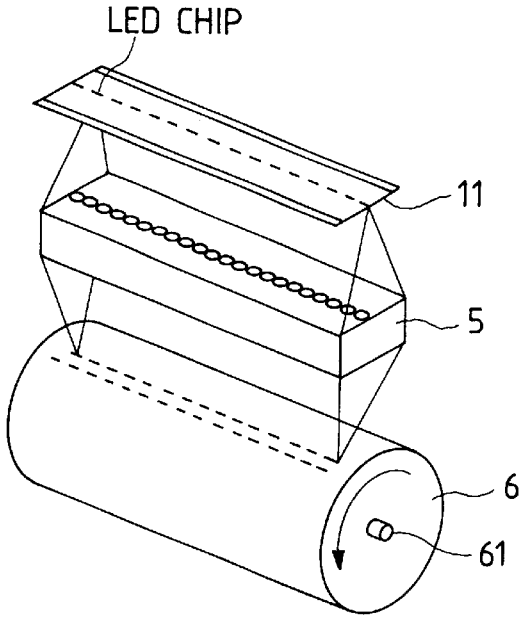
FIG. 9 is a perspective view of a main portion of an image forming apparatus having the LED array of the second embodiment.

The inclination angle of the light emitting point 14 with respect to the rotational axis 61 of the photosensitive drum 6 is determined by a transferring speed of the light emitting points 14 in the LED chip 12 and a peripheral speed of the photosensitive drum 6. FIG. 9 shows a main portion of an image forming apparatus using the LED array 11 according to the first embodiment of the present invention. As shown in FIG. 9, the light emitted from the LED array 11 passes through a SELFOC lens 5 and is exposed on the photosensitive drum 6 to form a latent image which is in turn visualized by the subsequent electrophotographic process.

Figure 10:
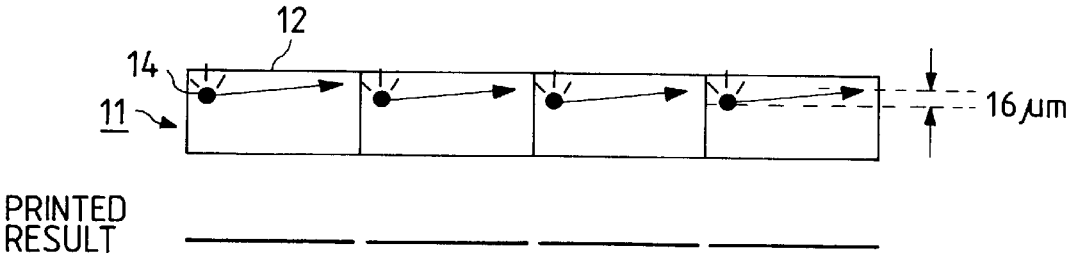
FIG. 10 is a schematic illustration showing a printed result obtained when an array of light emitting points in the LED chips according to the second embodiment is inclined by a predetermined angle with respect to a longitudinal direction of the chip.

FIG. 10 is a schematic illustration showing this embodiment. To eliminate image deviation, in the illustrated embodiment, when the LED chips 12 are manufactured, the light emitting points 14 in each LED chip 12 are inclined with respect to a longer side of the LED chip, i.e., the rotational axis 61 of the photosensitive drum 6 by an angle corresponding to the deviation value of 16 $\mu$m.

Figure 11:
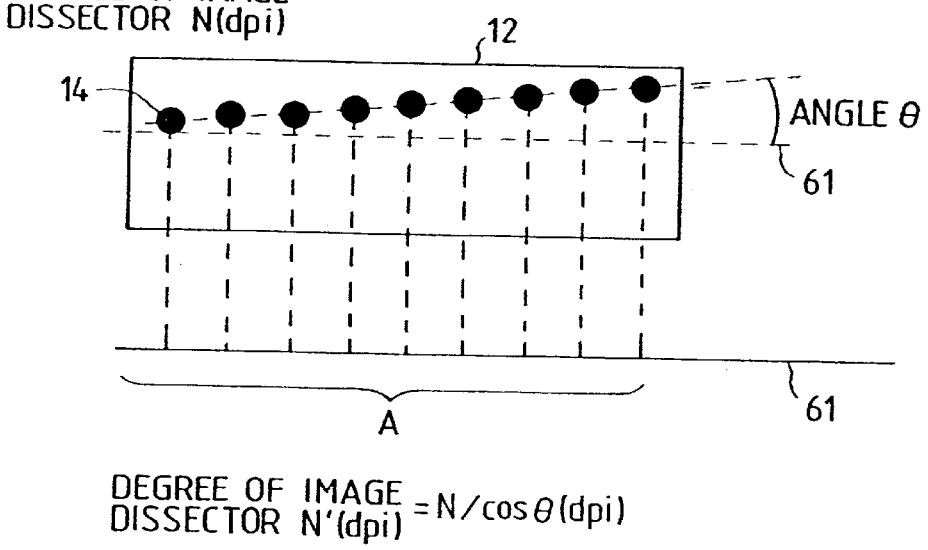
FIG. 11 is a schematic illustration showing a printed result in which degree of image dissector is changed when the inclination of the light emitting points is great.
Figure 12:
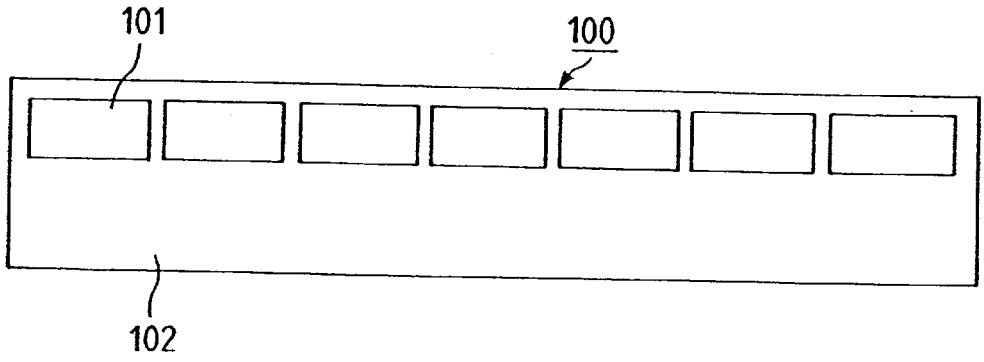
FIG. 12 PRIOR ART
FIG. 12 is a schematic illustration showing a conventional LED array.
Figure 13:
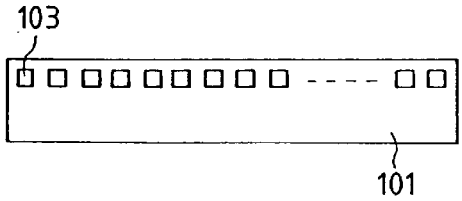
FIG. 13 PRIOR ART
FIG. 13 is a plan view of the conventional LED array.
Figure 14A:
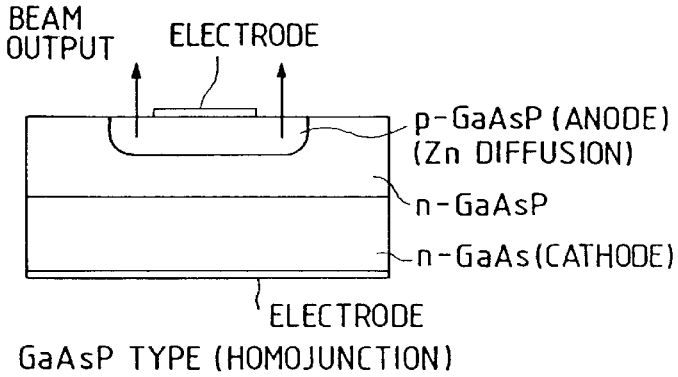
FIGS. 14A and 14B are sectional views showing the LED chip.
Figure 14B:
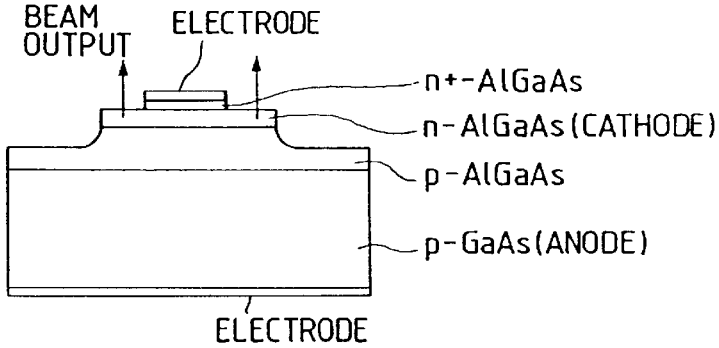
Figure 15:
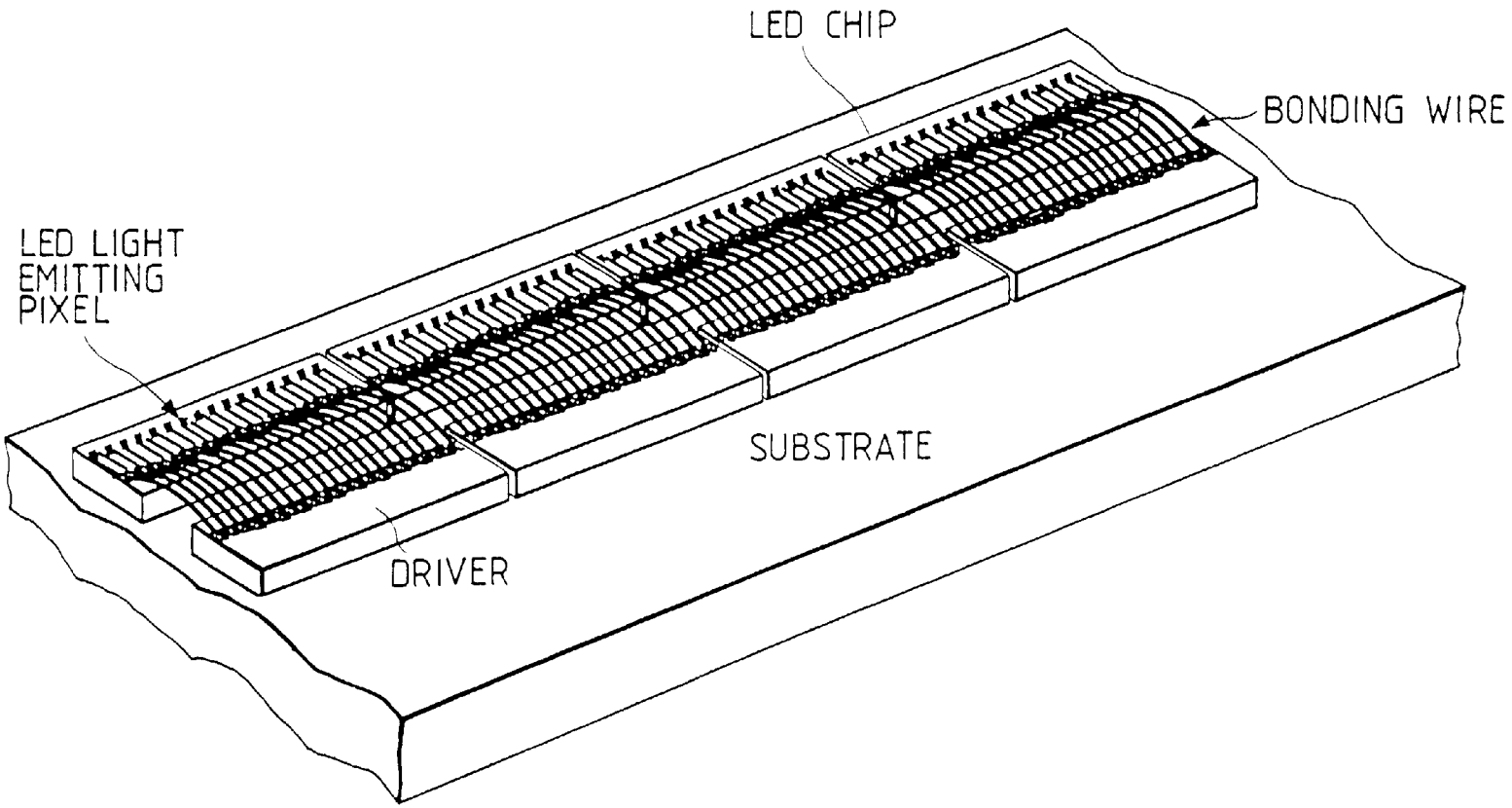
FIG. 15 PRIOR ART
FIG. 15 is a partial perspective view of the conventional LED array.

Incidentally, if the light emitting points 14 are greatly inclined with respect to the rotational axis 61 of the photosensitive drum 6, as shown in FIG. 11, the degree of image dissector of the LED N(dpi) will differ from the degree of image dissector of the pixel N'(dpi) written on the photosensitive drum 6. When an angle between the light emitting points 14 disposed in a line in the LED chip 2 and the rotational axis 61 of the photosensitive drum 6 is θ, the degree of image dissector N'(dpi) on the photosensitive drum 6 becomes greater than the degree of image dissector of the LED N(dpi) by (1/cos θ) times, with the result that the substantial conversion of the degree of image dissector occurs in the exposure system (as shown by the arrow A). However, in the illustrated embodiment, since the inclination angle θ corresponding to the deviation value of 16 μm is below 1°, the conversion (change) of the degree of image dissector can be neglected.

Further, if the image deviation corresponding to one LED chip 12 on the photosensitive drum 6 may be suppressed within ½ of the pixel size (not completely eliminated as mentioned above), a relation between the peripheral speed p (mm/sec) of the photosensitive drum 6 and the transferring speed v (Hz) of the light emitting point 14 may satisfy $p/v<1.24\times10^{-4}$.

In the illustrated embodiment, the arranging direction of the light emitting points 14 in each LED chip 12 is inclined with respect to the longer side of the LED chip 12, and, thus, the arranging direction is inclined with respect to the rotational axis 61 of the photosensitive drum 6 by a predetermined angle. This arrangement is finished when the LEDs are incorporated into the semi-conductor chip, and, in the bonding process for the LED chips 12, as is in the conventional cases, the LED chips are disposed in parallel with the rotational axis 61 of the photosensitive drum 6. Accordingly, by using this embodiment, an improved LED array 11 can be obtained without greatly altering the equipment.

The present invention is not limited to the illustrated embodiments, and various alterations can be effected within the scope of the invention.

What is claimed is:

1. An exposure apparatus for exposing a rotating photosensitive body, comprising:

a plurality of light emitting elements arranged in an axial direction of the photosensitive body; and light emission control means for making said light emitting elements emit light in order of arrangement of said light emitting elements, in accordance with an image signal, wherein said light emitting elements are disposed obliquely with respect to a rotation axis of the photosensitive body so that, in a rotation direction of the photosensitive body, a deviation of a position on the photosensitive body to be exposed by said light emitting elements on both ends of the arrangement, is greater than zero and is within ½ pixel.

2. An exposure apparatus according to claim 1, further comprising a plurality of chips on which said light emitting elements are provided, wherein each chip is disposed obliquely with respect to the rotation axis of the photosensitive body, and wherein the deviation of the position in exposure by light emitting elements located on opposite ends of each chip is greater than zero and within ½ pixel.

3. An exposure apparatus according to claim 2, further comprising a substrate on which the plurality of chips are provided, wherein on each said chip the light emitting elements on that chip are disposed parallel to a side of that chip, and wherein each chip is disposed in an inclined condition in a same direction with respect to a longitudinal direction of said substrate.

4. An exposure apparatus according to claim 3, wherein said light emitting elements comprise light emitting diodes.

5. An exposure apparatus according to claim 2, wherein said light emitting elements comprise light emitting diodes.

6. An exposure apparatus according to claim 1, wherein said light emitting elements comprise light emitting diodes.

7. An image forming apparatus comprising:

a photosensitive body having a rotation axis;

charging means for charging said photosensitive body;

a plurality of light emitting elements, arranged in an axis direction of said photosensitive body, for exposing said photosensitive body, which is charged, to form an electrostatic image;

light emission control means for making said light emitting elements emit light in order of arrangement in accordance with an image signal;

developing means for developing the electrostatic image; and transferring means for transferring a developed image, developed by said developing means, to a recording medium, wherein said light emitting elements are disposed obliquely with respect to the rotation of axis of said photosensitive body so that, in rotation direction of said photosensitive body, a deviation of a position on said photosensitive body to be exposed by said light emitting elements on both ends of the arrangement, is greater than zero and is within ½ pixel.

8. An image forming apparatus according to claim 7, further comprising a plurality of chips on which said light emitting elements are provided, wherein each chip is disposed obliquely with respect to the rotation axis of the photosensitive body, and wherein the deviation of the position in exposure by light emitting elements located on opposite ends of each chip is greater than zero and within ½ pixel.

9. An image forming apparatus according to claim 8, further comprising a substrate on which the plurality of chips are provided, wherein on each said chip the light emitting elements on that chip are disposed parallel to a side of that chip, and wherein each chip is disposed in an inclined condition in a same direction with respect to a longitudinal direction of said substrate.

10. An image forming apparatus according to claim 9, wherein said light emitting elements comprise light emitting diodes.

11. An image forming apparatus according to claim 8, wherein said light emitting elements comprise light emitting diodes.

12. An image forming apparatus according to claim 7, wherein said light emitting elements comprise light emitting diodes.

* * * * *